US008094118B2

(12) United States Patent
Pedram et al.

(10) Patent No.: US 8,094,118 B2
(45) Date of Patent: Jan. 10, 2012

(54) DYNAMIC BACKLIGHT SCALING FOR POWER MINIMIZATION IN A BACKLIT TFT-LCD

(75) Inventors: Massoud Pedram, Beverly Hills, CA (US); Ali Iranli, Pasadena, CA (US)

(73) Assignee: University of Southern California, Los Angeles, CA (US)

( * ) Notice: Subject to any disclaimer, the term of this patent is extended or adjusted under 35 U.S.C. 154(b) by 1623 days.

(21) Appl. No.: 11/367,841

(22) Filed: Mar. 2, 2006

(65) Prior Publication Data

US 2006/0209005 A1 Sep. 21, 2006

Related U.S. Application Data

(60) Provisional application No. 60/658,267, filed on Mar. 2, 2005.

(51) Int. Cl.
*G09G 3/36* (2006.01)

(52) U.S. Cl. ..... 345/102; 345/55; 345/89; 345/204

(58) Field of Classification Search ..... 345/102, 345/55, 89, 204
See application file for complete search history.

(56) References Cited

U.S. PATENT DOCUMENTS

| | | | | |
|---|---|---|---|---|
| 2002/0087307 | A1* | 7/2002 | Lee et al. | 704/233 |
| 2005/0001801 | A1* | 1/2005 | Kim | 345/89 |
| 2005/0134525 | A1* | 6/2005 | Tanghe et al. | 345/1.1 |
| 2006/0274026 | A1* | 12/2006 | Kerofsky | 345/102 |

OTHER PUBLICATIONS

Cheng, W.-C. and M. Pedram, "Power minimization in a backlit TFT-LCD display by concurrent brightness and contrast scaling," IEEE Transactions on Consumer Electronics, vol. 50, No. 1, pp. 25-32 (Feb. 2004).

Iranli, A. and M. Pedram, "DTM: Dynamic tone mapping for backlight scaling," Proc. of Design Automation Conf., Jun. 2005, pp. 612-617.

Iranli, A. et al., "HEBS: Histogram equalization for backlight scaling," Proc. of Design Automation and Test in Europe, Mar. 2005, pp. 346-351.

Lee, W-B. et al., "Backlight dimming in power-aware mobile displays," Proc. of Design Automation Conf, Jul. 2006, pp. 371-374.

Shim, H. et al., "A backlight power management framework for the battery-operated multi-media systems," IEEE Design and Test of Computers, vol. 21, No. 5, Sep./Oct. 2004, pp. 388-396.

* cited by examiner

*Primary Examiner* — Richard Hjerpe
*Assistant Examiner* — Leonid Shapiro
(74) *Attorney, Agent, or Firm* — Fish & Richardson P.C.

(57) ABSTRACT

An embodiment of the present invention is directed to a method for determining a pixel transformation function that maximizes backlight dimming while maintaining a pre-specified distortion level. The method includes determining a minimum dynamic range of pixel values in a transformed image based on an original image and the pre-specified distortion level and determining the pixel transformation function. The pixel transformation function takes a histogram of the original image to a uniform distribution histogram having the minimum dynamic range.

18 Claims, 8 Drawing Sheets

DYNAMIC BACKLIGHT SCALING FOR POWER MINIMIZATION IN A BACKLIT TFT-LCD

CLAIM OF PRIORITY UNDER 35 U.S.C. §119

The present Application for Patent claims priority to Provisional Application No. 60/658,267 entitled "Dynamic Backlight Scaling for Power Minimization in a Backlit TFT-LCD" filed Mar. 2, 2005, and assigned to the assignee hereof and hereby expressly incorporated by reference herein.

BACKGROUND

As portable electronic devices become more intertwined with everyday life of people, it becomes necessary to put more functionality into these devices, run them at higher circuit speeds, and have them consume smaller amounts of energy. These electronic devices are becoming smaller and lighter and are often required to operate with Liquid Crystal Displays (LCDs) for increasing periods of time. Unfortunately, the battery capacities are increasing at a much slower pace than the overall power dissipation of this class of electronic devices. Therefore, it is essential to develop design techniques to reduce the overall power dissipation of these devices.

In many of these devices, the energy consumption in the Cold Cathode Fluorescent Lamp (CCFL), which is the backlight of the LCD, dominates the overall energy consumption of the device. In some cases, the display backlight accounts for almost 50% of the battery drain when the display is at maximum intensity.

FIG. 1 shows the typical architecture of the digital LCD subsystem 100 in a microelectronic device. There are two main components in this subsystem: a) the graphics controller 110, which includes the video controller 111 and frame buffer memory 112 and b) the LCD component 120, which includes the LCD controller 121 and LCD panel 122. The image data, which is received from the processing unit, is first saved into the frame buffer memory 112 by the video controller 111 and is subsequently transmitted to the LCD controller 121 through an appropriate analog (e.g., VGA) or digital (e.g., DVI) interface 130. The LCD controller 121 receives the video data and generates a proper grayscale (i.e., transmissivity of the panel 122) for each pixel based on its pixel value. All of the pixels on a transmissive LCD panel are illuminated from behind by the backlight. To the observer, a displayed pixel looks bright if its transmittance is high (i.e., it is in the 'on' state), meaning it passes the backlight. On the other hand, a displayed pixel looks dark if its transmittance is low (i.e., it is in the 'off' state), meaning that it blocks the backlight. For color LCDs, different filters are used to generate shades of three main colors (i.e. red, blue, and green), and then color pixels are generated by mixing three sub-pixels together to produce different colors.

FIG. 2 depicts the LCD component 200 in more detail. The data received from the video bus 130 is used to infer timing information and respective grayscale levels for a row of pixels. Next, the pixel values are converted to the corresponding voltage levels to drive the thinfilm-transistors (TFT.s) on different columns of the selected row. The backlight bulb 221 is powered with the aid of a DC-AC converter 222, to provide the required illumination of the LCD matrix 223.

FIG. 3 illustrates a schematic for a common TFT cell 300. Each pixel has an individual liquid crystal cell, a TFT 310, and a storage capacitor. The electrical field of the capacitor controls the transmittance of the liquid crystal cell. The capacitor is charged and discharged by the TFT. The gate electrode of the TFT controls the timing for charging/discharging of the capacitor when the pixel is scanned (or addressed) by the tracer for refreshing its content. The (drain-) source electrode of the TFT controls the amount of charge. The gate electrodes and source electrodes of all TFTs are driven by a set of gate drivers and source drivers, respectively. A single gate driver (called a gate bus line 320) drives all gate electrodes of the pixels on the same row. The gate electrodes are enabled at the same time the row is traced. A single source driver (called a source bus line 330) drives all source electrodes of the pixels on the same column. The source driver 330 supplies the desired voltage level (called grayscale voltage) according to the pixel value. In other words, ideally, the pixel value transmittance, t(X), is a linear function of the grayscale voltage v(X), which is in turn a linear function of the pixel value X. The transfer function of source driver 330, which maps different pixel values, X, into different voltage levels, v(X) is called the grayscale-voltage function. If there are 256 grayscales, then the source driver 330 must be able to supply 256 different grayscale voltage levels. For the source driver 330 to provide a wide range of grayscales, a number of reference voltages are required. The source driver 330 mixes different reference voltages to obtain the desired grayscale voltages. Typically, these different reference voltages are fixed and designed as a voltage divider. Mathematically speaking, in a transmissive TFT-LCD monitor, for a pixel with value X, the luminance I(A) of the pixel is: $I(X)=b.t(X)$ where t(A) is the transmissivity of the TFT-LCD cell for pixel value X, and $b\epsilon[0,1]$ is the (normalized) backlight illumination factor with b=1 representing the maximum backlight illumination and b=0 representing no backlight. It should be appreciated that t(X) is a linear mapping from [0,255] domain to [0,1] range. In backlight scaled TFT-LCD, b is scaled down and accordingly t(X) is increased to achieve the same image luminance.

Previous approaches cannot fully utilize the power saving potential of the dynamic backlight scaling scheme because their measure of distortion between the original and the backlight-scaled image is an overestimation. This is because these approaches simply either minimize the number of saturated pixel values or maximize the number of pixel values that are preserved. Image distortion (more precisely, the difference between a pair of similar images) is a complex function of the visual perception, and hence, it cannot be correctly evaluated by comparing the images pixel by pixel (i.e., calculating the root mean squared error of the corresponding pixel values) or as a whole (i.e., using the integral of the absolute value of the histogram differences). A correct measure of distortion should appropriately combine the mathematical difference between pixel values (or histograms) and the characteristics of the human visual system.

SUMMARY

An embodiment of the present invention is directed to a method for determining a pixel transformation function that maximizes backlight dimming while maintaining a pre-specified distortion level. The method includes determining a minimum dynamic range of pixel values in a transformed image based on an original image and the pre-specified distortion level and determining the pixel transformation function. The pixel transformation function takes a histogram of the original image to a uniform distribution histogram having the minimum dynamic range.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Figure 1:
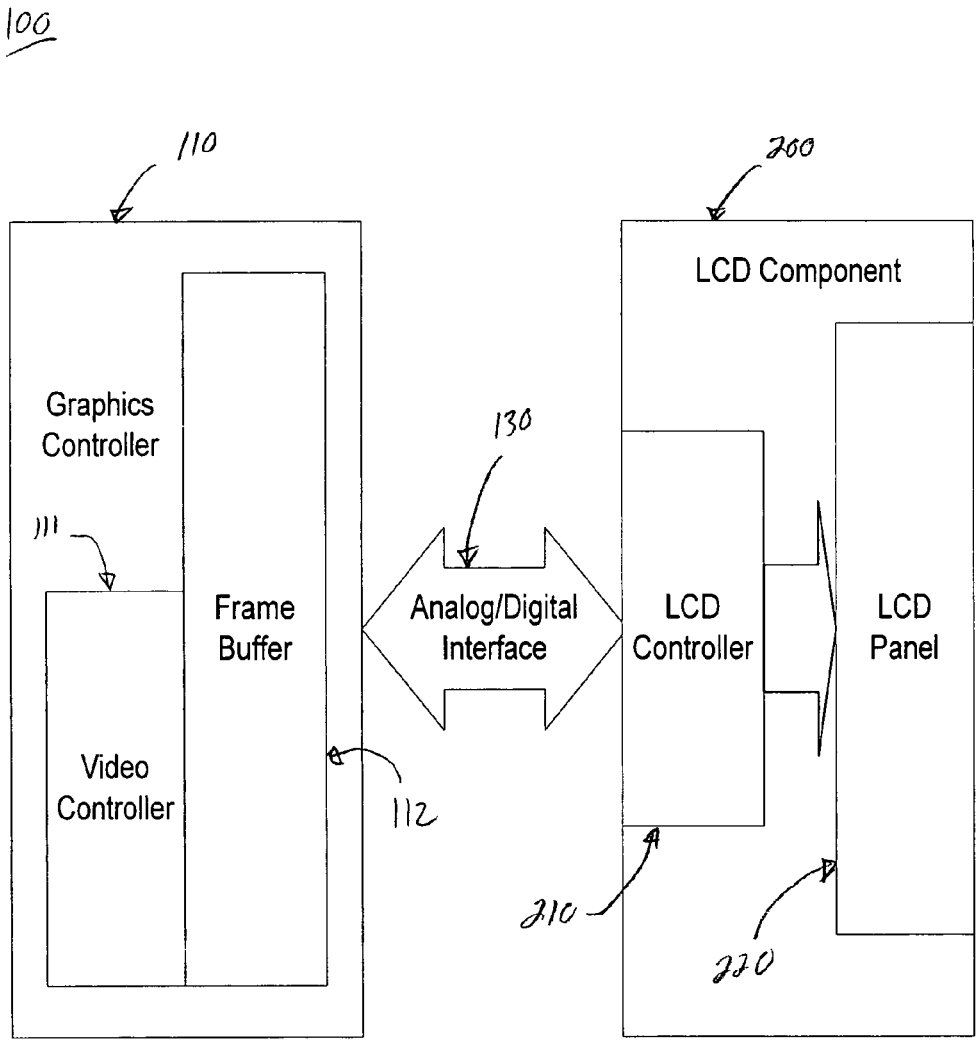
FIG. 1 shows the typical architecture of a common digital LCD subsystem in a microelectronic device.
Figure 2:
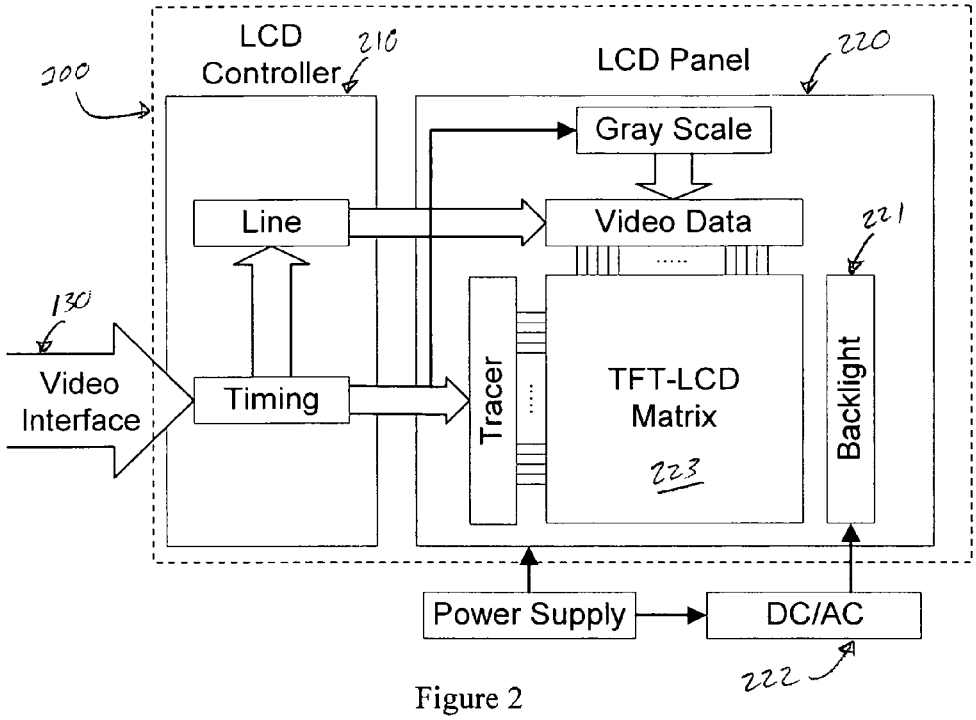
FIG. 2 shows a detailed diagram of a common LCD.
Figure 3:
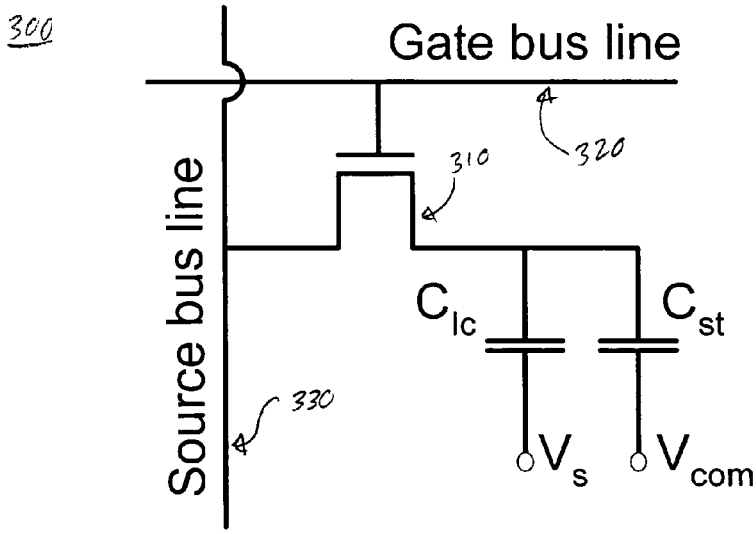
FIG. 3 illustrates a schematic for a common TFT cell.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions that follow are presented in terms of procedures, logic blocks, processing, and other symbolic representations of operations on data bits within a computer or digital system memory. These descriptions and representations are the means used by those skilled in the data processing arts to most effectively convey the substance of their work to others skilled in the art. A procedure, logic block, process, etc., is herein, and generally, conceived to be a self-consistent sequence of steps or instructions leading to a desired result. The steps are those requiring physical manipulations of physical quantities. Usually, though not necessarily, these physical manipulations take the form of electrical or magnetic signals capable of being stored, transferred, combined, compared, and otherwise manipulated in a computer system or similar electronic computing device. For reasons of convenience, and with reference to common usage, these signals are referred to as bits, values, elements, symbols, characters, terms, numbers, or the like with reference to the present invention.

It should be borne in mind, however, that all of these terms are to be interpreted as referencing physical manipulations and quantities and are merely convenient labels and are to be interpreted further in view of terms commonly used in the art. Unless specifically stated otherwise as apparent from the discussion herein, it is understood that throughout discussions of the present embodiment, discussions utilizing terms such as "determining" or "outputting" or "transmitting" or "recording" or "locating" or "storing" or "displaying" or "receiving" or "recognizing" or "utilizing" or "generating" or "providing" or "accessing" or "checking" or "notifying" or "delivering" or the like, refer to the action and processes of a computer system, or similar electronic computing device, that manipulates and transforms data. The data is represented as physical (electronic) quantities within the computer system's registers and memories and is transformed into other data similarly represented as physical quantities within the computer system memories or registers or other such information storage, transmission, or display devices.

Human Visual System (HVS)

Some embodiments of the present invention take into account the Human Visual System (HVS) during the backlight scaling process. When light reaches eye, it hits the photoreceptors on the retina, which send an electrical signal through nerves to the brain, where an image is formed. The photoreceptors in our retina, namely rods and cones, act as the sensors for the HVS. The incoming light can have a dynamic range of nearly $1:10^{14}$, whereas the neurons can transfer a signal with dynamic range of only about $1:10^{3}$. The human eye can discern a dynamic range of about 10-12 orders of magnitude. As a result, there is the need for some kind of adaptation mechanism in our vision. This means that we first adapt to some (unchanging) luminance value, and then perceive images in a rather small dynamic range around this luminance value. One of the most important characteristics that changes with different adaptation levels is the Just Noticeable Difference (JND.)

The Difference Threshold (or JND) is the minimum amount by which stimulus intensity must be changed in order to produce a noticeable variation in sensory experience. Let $\Delta L$ and $L_a$ denote the JND and the adaptation luminance, respectively. The ratio $\Delta L/La$ varies as a function of the adaptation level, La and thus, established the relationship between La and $\Delta L$ to be:

$$\Delta L(L_a)=0.0594\cdot(1.219+L_a^{0.4})^{2.5} \quad (1)$$

The above relationship, commonly known as Blackwell's equation, states that if there is a patch of luminance $La+\epsilon$ where $\epsilon \geqq \Delta L$ on a background of luminance La, it will be discernible, but a patch of luminance $La+\epsilon$, where $\epsilon<\Delta L$ will not be perceptible to the human eye. Brightness is the magnitude of the subjective sensation which is produced by visible light. Although the radiance can easily be measured, the brightness, being a subjective metric, cannot be exactly quantified. Nevertheless, brightness is often approximated as the logarithm of the luminance, or the luminance raised to the power of ½ to ⅓ depending on the context.

One formula uses the 'brils' units to measure the subjective value of brightness. Based on this formula, one bril equals the sensation of brightness that is induced in a fully dark-adapted eye by a brief exposure to a 5-degree solid-angle white target of 1 micro-lambert luminance. Let B denote brightness in brils, L the original luminance value in lamberts, and $L_a$ denote the adaptation luminance of the eye. Then, $$B = \lambda \cdot \left(\frac{L}{L_a}\right)^{\sigma} \quad (2)$$

where $$\sigma = 0.4 \cdot \log_{10}(L_a) + 2.92 \quad (3)$$

$$\lambda = 10^{2.0208} \times L_a^{0.336} \quad (4)$$

Figure 4:
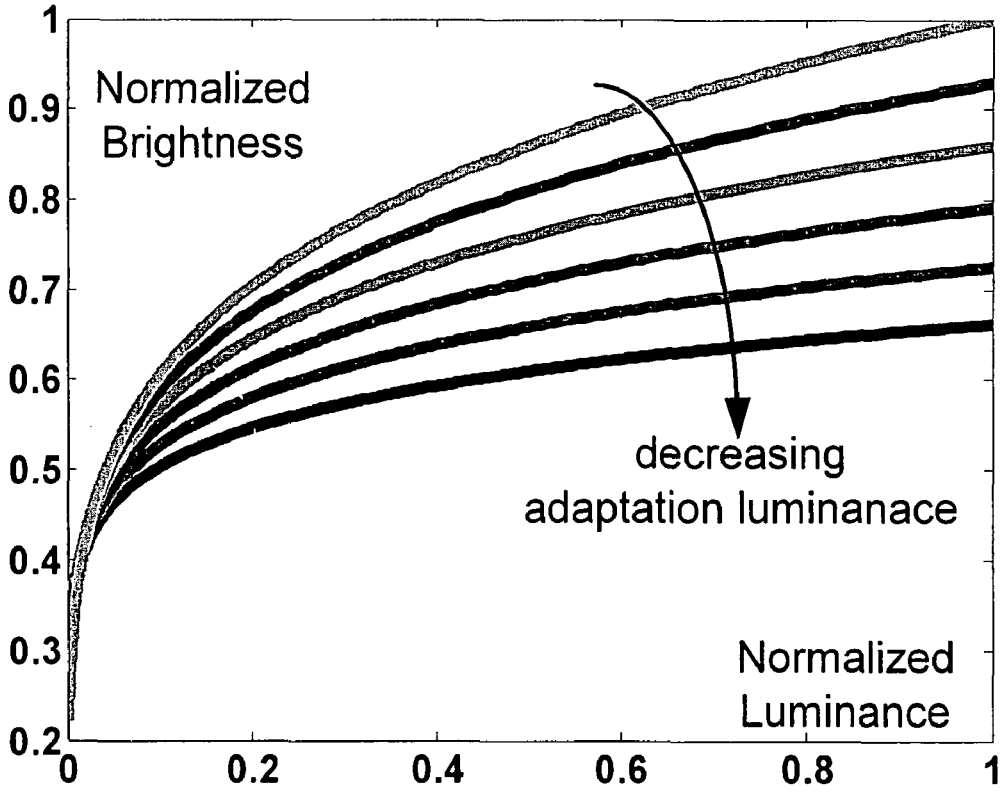
FIG. 4 shows a graph of typical perceived brightness characteristic curves via the human visual system.

Typical perceived brightness characteristic curves are shown in FIG. 4. The slope of each curve represents the human contrast sensitivity that is the sensitivity of the HVS brightness perception to the changes in the luminance. Furthermore, as $L_a$ is decreased, the human contrast sensitivity decreases. Finally, the HVS exhibits higher sensitivity to changes in luminance in the darker regions of an image.

Two images with different luminance values can result in the same brightness values, and can appear to the HVS as being identical. Moreover, Equation 2 illustrates that humans are very poor judges of an absolute luminance; all that humans can judge is the ratio of luminance values, i.e. the brightness.

Tone Reproduction

A classic photographic task is the mapping of the potentially high dynamic range of real world luminance values to the low dynamic range of the photographic print. The range of light that people experience in the real world is vast. However, the range of light one can reproduce on prints spans at best about two orders of absolute dynamic range.

The success of photography has shown that it is possible to produce images with limited dynamic range that convey the appearance of realistic scenes. This is fundamentally possible because the human eye is sensitive to relative, rather than absolute, luminance values. Consider a typical scene that poses a problem for tone reproduction in photography, a room illuminated by a window that looks out on a sunlit landscape. A human observer inside the room can easily see individual objects in the room as well as features in the outdoor landscape. This is because the eye adapts locally as we scan the different regions of the scene. If one attempts to photograph the same view, the result is disappointing. Either the window is over exposed and the outside cannot be seen, or the interior of the room is underexposed and appears dark.

Generally speaking, the tone reproduction techniques can be divided into two main categories. The first category of techniques uses a global tone mapping operator, which ignores the spatial information about the luminance of the original scene and adopts a single nondecreasing function as its tone mapping operator.

The second category of techniques tries to reproduce the visibility of different objects in the scene. This is done through multiple mapping functions which are adopted based on local luminance information of the original scene.

The basic challenge for a spatially varying tone mapping operator is that it needs to reduce the global contrast of an image without affecting the local contrast to which the HVS is sensitive. To accomplish this, an operator must segment the high dynamic range image, either explicitly or implicitly, into regions that the HVS does not correlate during dynamic range reduction. Otherwise, the local varying operators would result in disturbing "reverse gradients" which are typically observed as halos around light sources.

Dynamic Tone Mapping (DTM)

Some embodiments of the present invention are directed to a system and method for dynamic tone mapping for backlight scaling. One embodiment is implemented entirely in software. Another embodiment is implemented in hardware with software support. The embodiments described herein are described in LCD displays for the purpose of illustration. However, it will be apparent to one skilled in the art that embodiments are equally applicable in other display technologies including, but not limited to, LED arrays and organic LED displays.

First, Let $L_{max}^{orig}$ and $L_{max}^{DTM}$ denote the maximum luminance of the original image and the dynamically tone-mapped and backlight-scaled image, respectively. Moreover, let $\chi^{orig}$ and $\chi^{DTM}$ denote the pixel value information of the original and backlight scaled images. Then, the perceived image distortion between images $\chi^{orig}$ and $\chi^{DTM}$ can be quantified by function $D(\chi^{orig}, \chi^{DTM})$.

Converse Tone Mapping (CTM) Problem: Given an original image $\chi^{orig}$ and maximum allowable image distortion $D_{max}$, find the tone mapping operation $\psi:[0, L_{max}^{orig}] \rightarrow [0, L_{max}^{DTM}]$ such that max $L_{max}^{DTM}$ is minimized while $$D(\chi^{orig}, \chi^{DTM}) \leq D_{max} \quad (5)$$

where $\chi^{DTM} \equiv \psi(\chi^{orig})$.

The aforementioned problem is the converse of the tone mapping problem, because in the tone mapping problem, the goal of optimization is to find the mapping operator $\psi$ such that for a given maximum display luminance, the image distortion is minimized. In contrast, in the CTM problem, the goal of optimization is to find the minimum of maximum luminance value that guarantees a given maximum image distortion level. Unfortunately, due to complexity of HVS, and therefore the complexity of the image distortion function, D, neither the CTM problem nor the tone mapping problem have closed form solutions.

To solve the CTM problem, a heuristic approach based on pixel brightness preservation is proposed. The key idea is to make sure that the JND in the backlight scaled image and that in the original image are equal. In this way, the image perception is preserved, i.e., both images have the same discernible details.

Mathematically speaking, let $L_a^{orig}$ and $L_a^{DTM}$ denote the adaptation luminance for the original and the backlight scaled images. Based on Equation (1), the JND for the original image is $\Delta L(L_a^{orig})$ and the JND for the backlight scaled image will be (DTM) $\Delta L(L_a^{DTM})$. Therefore, to preserve the discernible details of the image, it is necessary to find a tone mapping function, $\psi$, such that $\Delta L(L_a^{DTM}) = \psi(\Delta L(L_a^{orig}))$.

As one solution, one can assume a variable scaling function where the scaling factor changes depending upon the local luminance value. Subsequently, the lighter regions of the image will be scaled more non-linearly than the darker regions so as to take advantage of the decreasing human contrast sensitivity from dark to light regions of the image. However, this approach requires manipulation of individual pixel values, which may be undesirable real-time implementation. Therefore, one embodiment adopts $\psi$ to be a constant scaling function $\psi(x) = \kappa \cdot x$, where $\kappa$ can be calculated from equation (6) as a function of $L_a^{orig}$ and $L_a^{DTM}$:

$$\kappa = \left(\frac{1.219 + (L_a^{DTM})^{0.4}}{1.219 + (L_a^{orig})^{0.4}}\right)^{2.5} \quad (6)$$

where $L_a^{orig}$ and $L_a^{DTM}$ may be approximated by half of the maximum backlight luminance before and after backlight scaling, i.e., 0.5 $L_{max}^{orig}$ and 0.5 $L_{max}^{DTM}$.

In addition, to capture the human contrast sensitivity, one embodiment uses a functional form for the transformation function, ψ, which is similar to that of the human brightness perception function, (i.e., Equation (2)):

$$\psi(\chi^{orig}) = \kappa(L_a^{orig}, L_a^{DTM}) \cdot \left(\frac{\chi^{orig}}{L_a^{orig}}\right)^{\gamma(L_a^{orig}, L_a^{DTM})} \quad (7)$$

where $\kappa(L_a^{orig}, L_a^{DTM})$ is simply the luminance intensity adjustment factor as given by equation (6) and $\gamma(L_a^{orig}, L_a^{DTM})$ is the human contrast sensitivity change between the original image and the backlight scaled image, which can be defined as:

$$\gamma(L_a^{orig}, L_a^{DTM}) = \left(\frac{\sigma^{orig}}{\sigma^{DTM}}\right) \quad (8)$$

The motivation behind introduction of parameter $\gamma(L_a^{orig}, L_a^{DTM})$ is to affect large and small luminance values differently. More precisely, if only the $\kappa(L_a^{orig}, L_a^{DTM})$ factor was used, in the transformed backlight scaled image the contrast between two pixels would have been increased uniformly with respect to that of the original image; however, with introduction of $\gamma(L_a^{orig}, L_a^{DTM})$, as the contrast between two pixels in the original image increases the contrast between same two pixels in the backlight scaled image would increase but, grow more slowly for smaller pixel luminance values. Therefore, the result would be a single tone mapping function which takes into account the sensitivity saturation of HVS.

Next, a distortion function (D) must be derived. In one embodiment, first the image distortion function is characterized for a set of benchmark images as a function of the dynamic range of the tone-mapped images. Next, standard curve fitting tools are used to generate an empirical image distortion curve based on this data. Later, this empirical curve is used as the image distortion function D to find the minimum required dynamic range for any given image to achieve the maximum image distortion of $D_{max}$ after tone-mapping.

Figure 5:
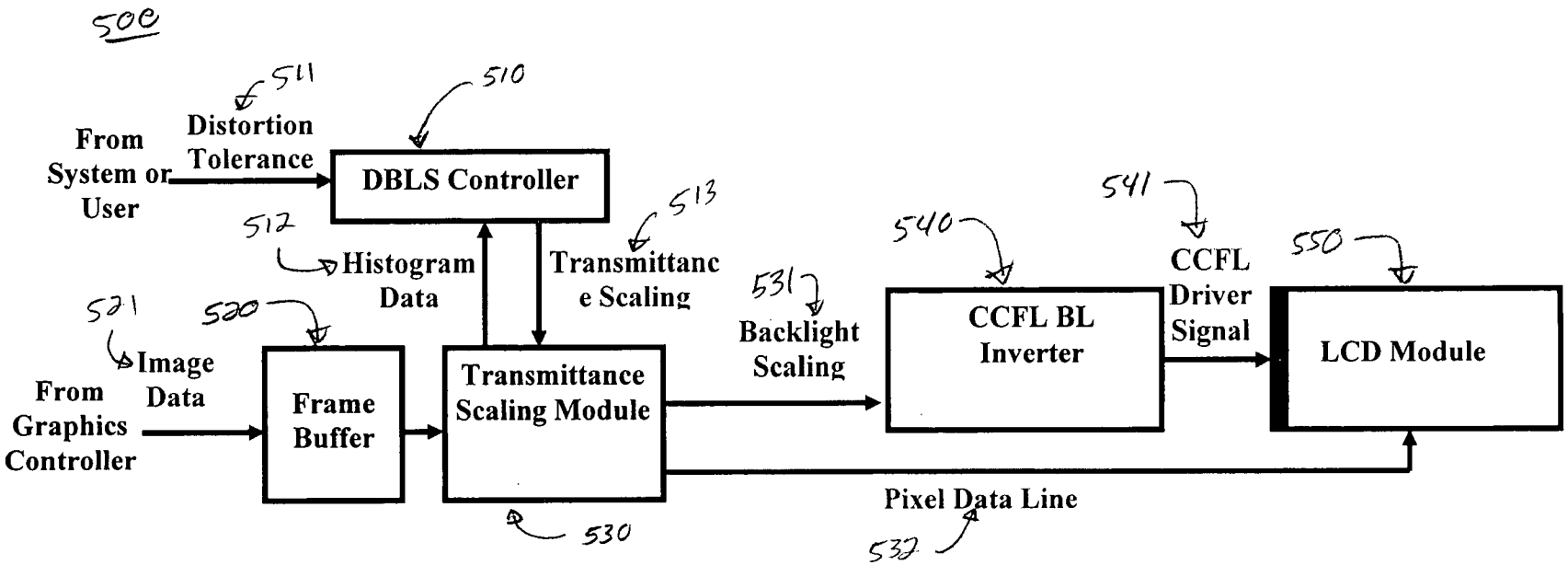
FIG. 5 illustrates an apparatus for implementing Dynamic Tone Mapping, in accordance with an embodiment of the present invention.

In one embodiment, DTM is implemented in hardware with minor software support. FIG. 5 illustrates an apparatus 500 for implementing DTM, in accordance with an embodiment of the present invention. Naturally, a hardware implementation may be more costly than a purely software implementation, but it can achieve a much more aggressive CCFL backlight dimming. Apparatus 500 includes a transmittance scaling module 530, which is coupled to a DBLS controller 510, a frame buffer 520, a CCFL BL Inverter 540, and an LCD module 550. In one embodiment, transmittance scaling module 530 implements the pixel value bucket counters, comparators, backlit scaling value calculator, pixel transmittance value calculator, and LCD timing controller. Transmittance scaling module 530 may include a hardware register level histogram analyzer, grayscale counters, a multiplier, and a clock generator.

Image data 521 is fed into frame buffer 520, which is in turn fed into transmittance scaling module 530. Transmittance scaling module 530 derives histogram data 512 based on the image data 521 and in turn provides it to DBLS controller 510. Based on the histogram data 512, a distortion tolerance parameter 511 provided by the system/user, and the above HVS-aware algorithms, DBLS controller 510 determines a transmittance scaling value 513 and provides it to the transmittance scaling module 530. Transmittance scaling module 530 subsequently scales the RGB values of individual pixels (that have been read from frame buffer 520) and puts these values on a pixel data line 532. Concurrently, the transmittance scaling module 530 sets the backlight scaling value 531 for the CCFL BL inverter 540, which in turn delivers a driver signal 541 to LCD module 550.

Histogram Equalization for Backlight Scaling

Other embodiments of the present invention are directed to a system and method for determining a pixel transformation function that maximizes backlight dimming while maintaining a pre-specified distortion level. One embodiment is implemented entirely in software. Another embodiment is implemented in hardware with software support. The embodiments described herein are described in LCD displays for the purpose of illustration. However, it will be apparent to one skilled in the art that embodiments are equally applicable in other display technologies including, but not limited to, LED arrays and organic LED displays.

First, let $\chi$ and $\chi'=\Phi(\chi,\beta)$ denote the original and the transformed image data, respectively. Moreover, let $D(\chi, \chi')$ and $P(\chi', \beta)$ denote the distortion of the images $\chi$ and $\chi'$ and the power consumption of the LCD-subsystem while displaying image $\chi'$ with backlight scaling factor, $\beta$.

Dynamic Backlight Scaling (DBS) Problem: Given the original image $\chi$ and the maximum tolerable image distortion $D_{max}$, find the backlight scaling factor $\beta$ and the corresponding pixel transformation function $\chi'=\Phi(\chi,\beta)$ such that $P(\chi', \beta)$ is minimized and $D(\chi, \chi') \leqq Dmax$.

The general form of DBS problem as stated above is difficult to solve due to the complexity of the distortion function, D, and also the non-linear function minimization step that is required to determine $\Phi(\chi,\beta)$. One embodiment simplifies this problem by 1) fully utilizing the dynamic range of the transformed image $\chi'$ in order to achieve the minimum TFT-LCD power consumption $P(\chi', \ldots \beta)$ and 2) by constraining the pixel transformation function to the family of piecewise linear functions (because these piecewise linear functions are desirable from implementation point of view).

Intuitively, to reduce the dynamic range of a given image one can discard the pixels corresponding to the grayscale levels with low population. This in turn minimizes the number of discarded pixels and hence minimizes the image distortion. On the other hand, for an image with a histogram which is uniformly populated with pixels in different grayscale levels, every level is as important as the other and discarding any grayscale level can cause a significant image distortion. Therefore, a good transformation which solves the DBS problem (i.e., minimizes $P(\chi', \beta)$), is the one which transforms the original image histogram into a uniform intensity histogram with a minimal dynamic range. One embodiment deals with the complexity of the distortion function as follows. The dynamic range of a benchmark image is set to some target value and the distortion value of the transformed image is plotted as a function of this target range. This process is then repeated for a number of different target ranges per image and for a large number of images in the database. Next, resorting to standard regression analysis techniques, the best global fit to these distortion values is calculated. The result will be an empirical curve which maps the observed distortion function values to target dynamic range of transformed images (i.e., the distortion characteristic curve).

One embodiment utilizes a global histogram equalization scheme in which the intensity values in the image are altered such that the resulting image has the uniform intensity histogram, with the desired minimum ($g_{min}$) and maximum ($g_{max}$) grayscale limits. This transformation may be accomplished by the use of the cumulative distribution function of the pixel intensities to generate the intensity remapping function. In this approach the resulting image will utilize the available display levels very well, because the transformation function is based on the statistics of the entire image.

The cumulative distribution histogram of the original image shall be denoted by H, and different grayscale values of the image pixels by x, which are selected from a finite set of values G, (e.g. G=[0 . . . 1]). Transformation function $\Phi:G\rightarrow G$ is a monotonic function, which maps the original pixel values x into a new pixel values x' and thereby equalizes cumulative histogram H to become the cumulative uniform histogram, U (i.e., a sloped line going from 0 to N, where N represents the number of pixels over which the histogram has been calculated, i.e. number of pixels in the image).

Global Histogram Equalization (GHE) Problem: Given the original image cumulative histogram H, find a monotonic transformation $\Phi:G\rightarrow G$ where G=[. . . 1] such that $\int|U(\Phi(x))-H(x)|\cdot dx$ is minimized.

If the targeted histogram is a uniform distribution between upper and lower limits, $g_{min}$ and $g_{max}$, then, to minimize the above equation, the transformation function $\Phi$ should be set to:

$$\Phi(x) = U^{-1}(H(x)) = g_{min} + (g_{max} - g_{min}) \cdot \frac{H(x)}{N} \tag{9}$$

In actual implementation, it is common to have a discrete version of the histogram instead of the cumulative histogram. To convert this equation into a histogram based formulation, one can differentiate both sides of Equation (9) to obtain:

$$\frac{d\Phi(x)}{dx} = (g_{max} - g_{min}) \cdot \frac{h(x)}{N} \tag{10}$$

where h(x) denotes the marginal distribution histogram. The first order difference approximation for the differentiation operator can then be used to calculate the discrete transfer function as:

$$\Phi(x_i) = g_{min} + (g_{max} - g_{min}) \cdot \sum_{k=0}^{i-1} \Delta x_k \cdot \frac{h(x)}{N}; \tag{11}$$

$$\Delta x_k \equiv x_{k+1} - x_k$$

where $x_i \epsilon G$ are the center points for the histogram buckets and $h(x_k)$ are the histogram value.

Figure 6:
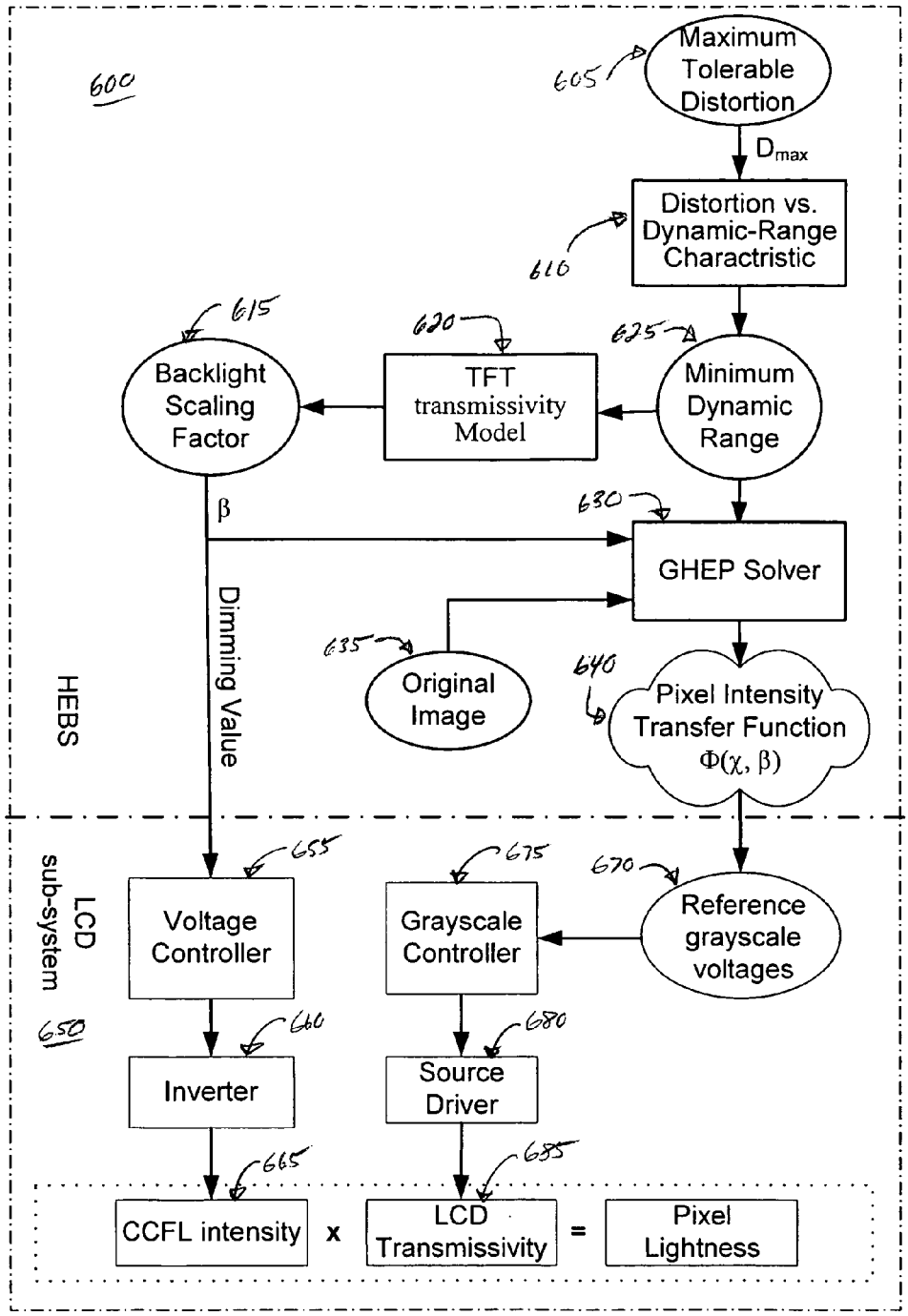
FIG. 6 illustrates a block diagram of a Histogram Equalization for Backlight Scaling system, in accordance with an embodiment of the present invention.

FIG. 6 illustrates a block diagram of a HEBS system 600, in accordance with an embodiment of the present invention. In one embodiment, a user-specified maximum tolerable image distortion 605 is first read as an input and is subsequently used to look up the minimum admissible dynamic range 625 for the image 635 from the distortion characteristic curve 610. Using this minimum admissible dynamic range 625 and the transmissivity characteristics of the TFT display 620, a maximum backlight scaling factor (615), β, is calculated and used to scale down the CCFL intensity 665 of LCD sub-system 650 via its voltage controller 655 and inverter 660. Moreover, this minimum dynamic range 625 along with the original image histogram 635 will be used by the GHE problem solver 630 to calculate the pixel transformation function $\Phi(\chi,\beta)$ 640. Next, the transformation function is approximated by a piecewise linear function, $\Lambda(\chi,\beta)$ (not shown), which is in turn used to determine the reference grayscale voltages, and to transform the original pixel values to new ones for the displayed image. The reference grayscale voltages 670 are then used to adjust the transmissivity 685 of LCD sub-system 650 via its grayscale controller 675 and source driver 680.

Figure 7:
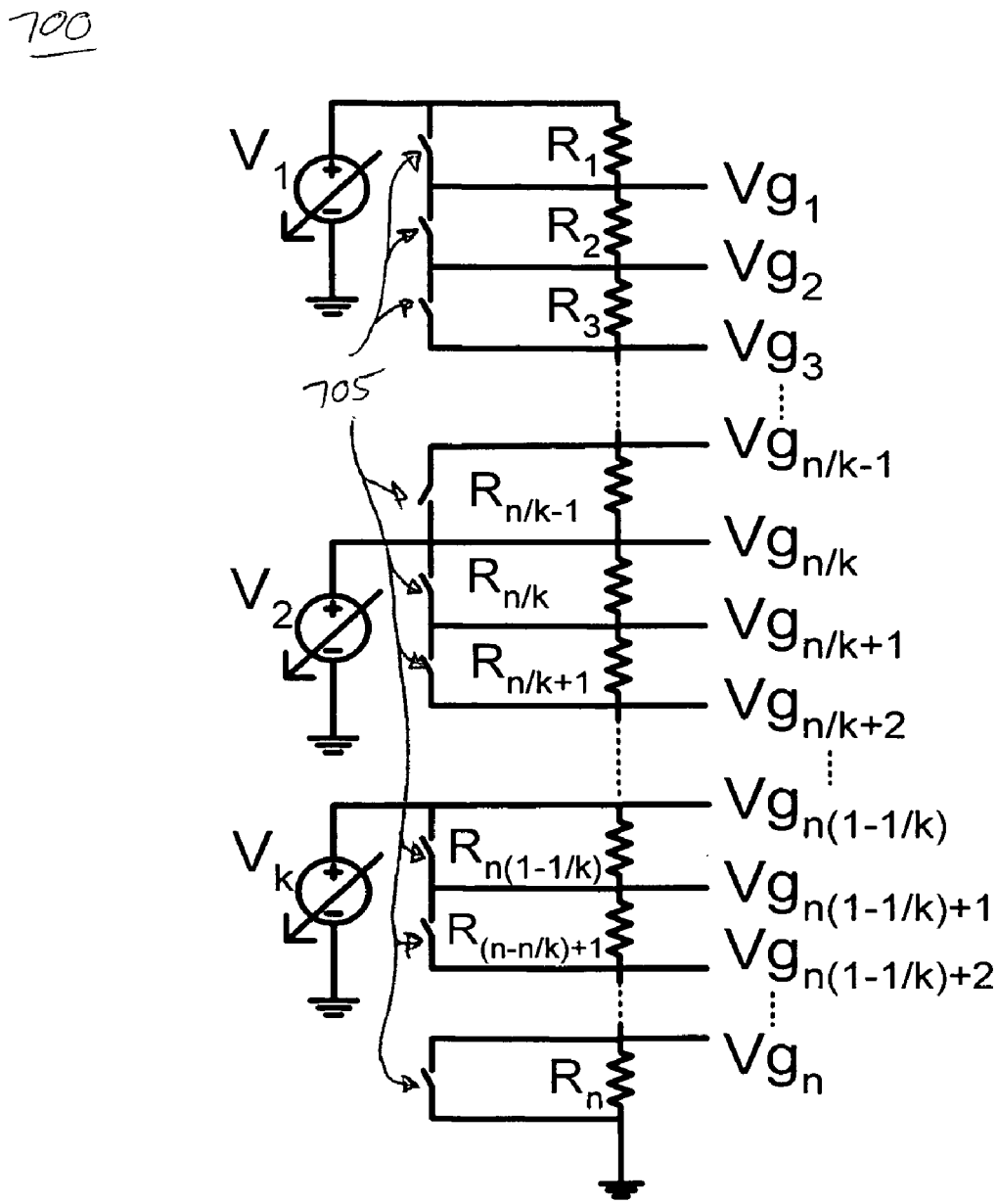
FIG. 7 shows a circuit schematic for a hierarchical structure of reference voltage dividers for a Histogram Equalization for Backlight Scaling system, in accordance with an embodiment of the present invention.

To implement HEBS, a hierarchical structure 700 is used for the reference voltage dividers as shown in FIG. 7. This structure 700 provides more flexibility in creating different slopes for multiple linear regions of the grayscale-voltage transfer function. Moreover, adding switches 705 between different grayscale levels enables one to provide flat-bands not only at the two ends of the image histogram, but also in the middle range of the gray scale levels.

To achieve multiple output slopes for the grayscale-voltage transfer function, k different controllable voltage sources $V_i$ are needed. These voltage sources $V_i$ are normally set to voltage levels $$V_i = \frac{i}{k} V_{dd} \text{ with } i = 1 \ldots k,$$

creating a transfer function with slope of one. Here $V_{dd}$ denotes the supply voltage, and i and k denote the voltage source number and total number of available voltage sources. To create different slopes for different regions of the grayscale values, one can change the voltage levels of controllable sources $V_i$ to create a k-band grayscale spreading function as described below. One embodiment involves approximating the pixel transformation function $\Phi(\chi,\beta)$ with a piecewise linear function $\Lambda(\chi,\beta)$, and then determining the voltage levels $V_i$, to implement this approximated function.

TFT-LCD displays are only capable of displaying a finite number of different grayscale levels, therefore, the input and output values of the transformation function $\Phi(\chi,\beta)$ are discrete. This observation implies that even the exact form of the transformation function $\Phi(\chi,\beta)$ is a piecewise linear function. However, the number of linear segments of $\Phi(\chi,\beta)$ is O(G), which is too large for efficient hardware implementation. Therefore, $\Phi(\chi,\beta)$ is approximated with another piecewise linear function that has a small number of linear segments.

Let $P=\{p_l, \ldots, p_n\}=\{(x_l, y_l), \ldots, (x_n, y_n)\}$ denote the ordered set of endpoints of each linear segment in exact form of $\Phi(\chi,\beta)$ starting from x1=0 for the darkest to $x_n$=255 for the brightest grayscale level. Moreover, let $Q=\{q_l, \ldots, q_m\}$, denote the ordered set of the endpoints of linear segments in $\Lambda(\chi,\beta)$, which is the approximation of $\Phi(\chi,\beta)$ Clearly, we have the following:

$$Q \subset P \tag{12}$$

$q_l=p_l$ and $q_m=p_n$; $q_i=p_j$ and $q_{i+l}=p_k$ where k>j

Piecewise Linear Coarsening (PLC) Problem: Given a piecewise linear curve P, approximate it by another piecewise linear curve Q with a given number of line segments m so that the mean squared error between $\Phi(\chi,\beta)$ and $\Lambda(\chi,\beta)$ is minimized.

The PLC problem can be solved by using a dynamic programming technique. Let E(n,m) denote the mean squared error between the original curve with n points and its best approximation with m≦n points. Then, $$E(n, m) = \min_{j=m-1\ldots n-1} (E(j, m-1) + e(j)) \tag{13}$$

$$E(1, 0) = 0,\ E(n, 0) = \infty, \text{ and } E(1, m) = 0 \forall\ m, n$$

where e(j) denotes the mean squared error incurred by approximating all segments between $p_j$ and $p_n$ by a single line connecting $p_j$ to $p_n$. Time complexity of this algorithm is $O(mn^2)$.

Using the solution for the PLC problem, the voltage level $V_i$, is $$V_i = \frac{Y_{q_i}}{\beta} \cdot V_{dd}$$

where $Y_{q_i}$ denotes the y-component of point $q_i$. It should be appreciated that the backlight dimming factor β is present in denominator to spread the grayscale level of the resulting image, and hence, compensate for the loss of brightness due to backlight dimming.

Figure 8:
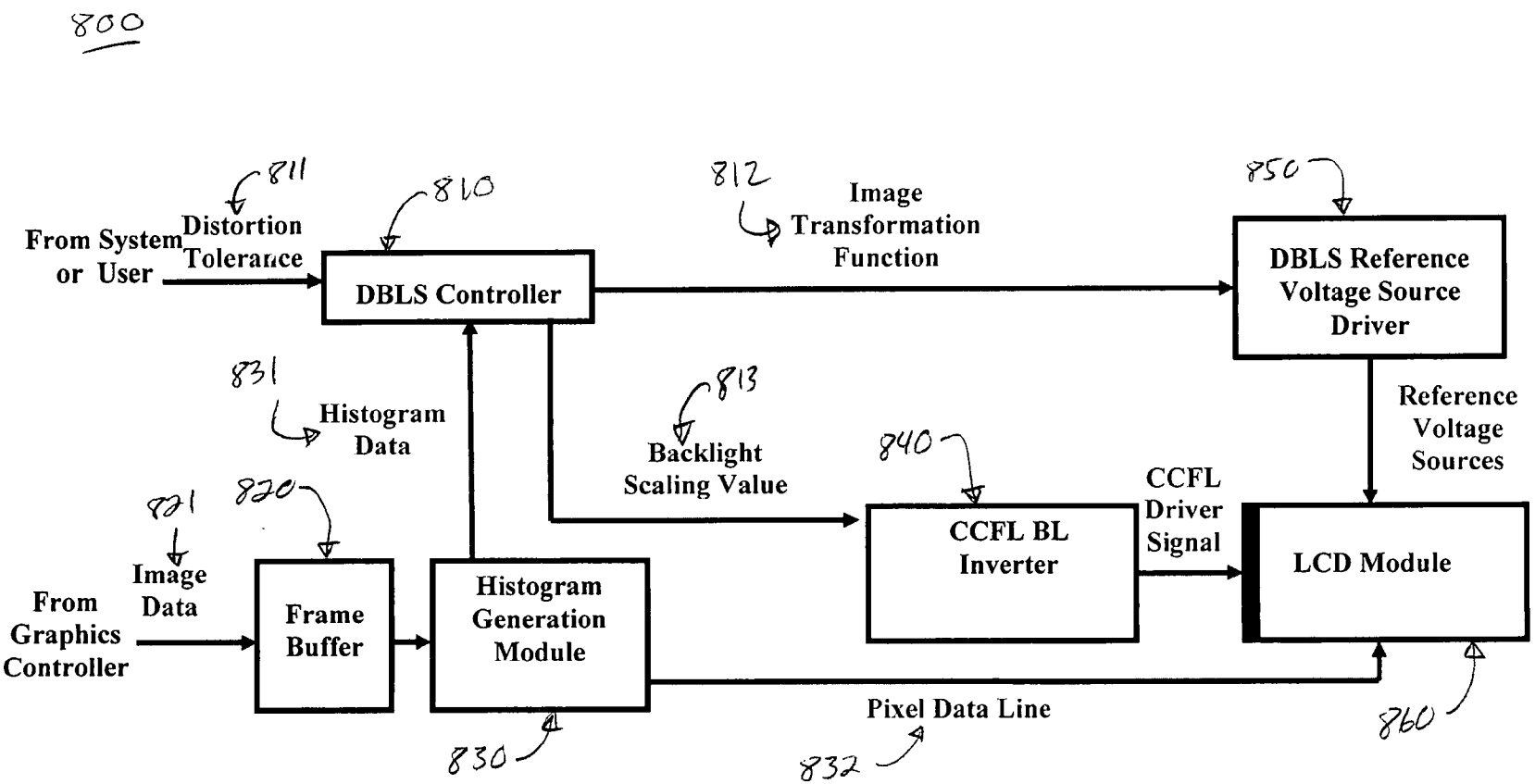
FIG. 8 illustrates an apparatus 800 for implementing Histogram Equalization for Backlight Scaling, in accordance with an embodiment of the present invention.

In one embodiment, HEBS is implemented in hardware with minor software support. FIG. 8 illustrates an apparatus 800 for implementing HEBS, in accordance with an embodiment of the present invention. Naturally, a hardware implementation may be more costly than a purely software implementation, but it can achieve a much more aggressive CCFL backlight dimming. Apparatus 800 includes frame buffer 820, which receives image data 821 from a graphics controller (not shown). Image data 821 may be retrieved from frame buffer 820 by a histogram generation module 830. Histogram generation module 830 is similar to the transmittance scaling module 530 of DTM, but it may be simpler. In particular, it need only implement the pixel value bucket counters and comparators to construct the image histogram on the fly. In addition, histogram generation module 830 may include a hardware register level histogram analyzer, grayscale counters, a multiplier, and a clock generator.

Histogram generation module 830 scales the RGB values of individual pixels (that have been read from frame buffer 820) and puts these values on a pixel data line 832. Histogram generation module 830 also derives histogram data 831 based on the image data 821 and in turn provides it to DBLS controller 810. Based on the histogram data 831 and image processing algorithms, DBLS controller 810 determines the minimum required dynamic range of the image 821. Next, using this calculated parameter and a distortion tolerance parameter 811 provided by the system/user, it output the image transform function 812 (a.k.a. the Multi-band Scaling Function). In one embodiment, the image transform function 812 is output in the form of eight 8-bit values. Concurrently, the DBLS controller 810 sets the backlight scaling value 813 for the CCFL BL inverter 840.

Software Implementations

Figure 9:
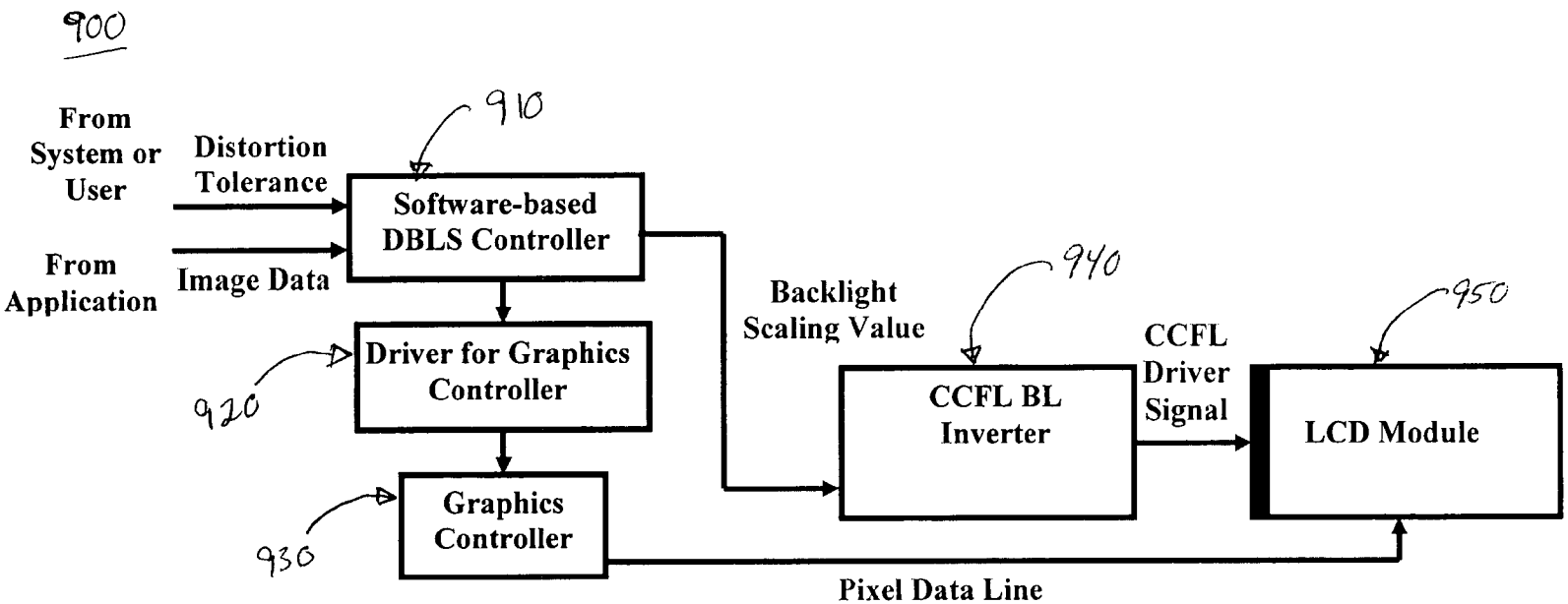
FIG. 9 is a block diagram for a software implementation for either Histogram Equalization for Backlight Scaling or Dynamic Tone Mapping, in accordance with an embodiment of the present invention.

In addition to the hardware implementations described above, both HEBS and DTM may similarly be implemented in software. FIG. 9 is a block diagram for a software implementation 900 for either HEBS or DTM, in accordance with an embodiment of the present invention. Implementation 900 relies a standard graphics controller 930, LCD controller 950, inverter 940, etc. without any hardware change to the existing circuit modules. It should be appreciated that is implementation 900 has a lower cost than a hardware implementation but may not achieve the same level of backlight power saving. Thus in implementation 900, software-based DBLS controller 910 performs essentially the same functions as transmittance scaling module 530, DBLS controller 510, and frame buffer 520 of apparatus 500, and it performs essentially the same functions as frame buffer 820, histogram generation module 830, and DBLS controller 810 in apparatus 800.

Thus, embodiments of the present invention achieve higher power savings compared to previous backlight dimming approaches. This is partially due to the fact that some optimization is based on the human visual system characteristics, rather than luminance values. Furthermore, power savings are capable of extending battery life in devices using TFT LCDs, LED arrays, organic LED displays, and the like, with minimal performance overhead and display quality degredation.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for determining a pixel transformation function that maximizes backlight dimming while maintaining a pre-specified distortion level comprising:

determining a minimum dynamic range of pixel values in a transformed image based on an original image ($\chi^{orig}$) and the pre-specified distortion level;

determining a scaling factor (κ) based on an adaptation luminance of the original image ($L_a^{orig}$) and an adaptation luminance of the transformed image ($L_a^{DTM}$);

determining a human contrast sensitivity change (γ) between the original image and the transformed image; and deriving the pixel transformation function (ψ), wherein the pixel transformation function includes the scaling factor and the human contrast sensitivity change, and wherein the pixel transformation function produces the transformed image such that the perceived brightness of the transformed image is preserved while maintaining the minimum dynamic range, wherein $$\psi(\chi^{orig}) = \kappa(L_a^{orig}, L_a^{DTM}) \cdot \left(\frac{\chi^{orig}}{L_a^{orig}}\right)^{\gamma(L_a^{orig}, L_a^{DTM})}.$$

2. The method as recited in claim 1 wherein $$\kappa(L_a^{orig}, L_a^{DTM}) = \left(\frac{1.219 + (L_a^{DTM})^{0.4}}{1.219 + (L_a^{orig})^{0.4}}\right)^{2.5}.$$

3. The method as recited in claim 1 wherein $$\gamma(L_a^{orig}, L_a^{DTM}) = \frac{0.4 \cdot \log_{10}(L_a^{orig}) + 2.92}{0.4 \cdot \log_{10}(L_a^{DTM}) + 2.92}.$$

4. The method as recited in claim 1 wherein $L_a^{orig}$ and $L_a^{DTM}$ are approximated by ½ $L_{max}^{orig}$ and ½ $L_{max}^{DTM}$ respectively, wherein $L_{max}^{orig}$ and $L_{max}^{DTM}$ denote the maximum luminance of the original image and the transformed image respectively.

5. The method as recited in claim 1 wherein the pre-specified distortion level is user-defined.

6. The method as recited in claim 1, further comprising:
deriving histogram data based on the image data; and
determining a transmittance scaling value based on the transformed image.

7. A system for dynamic backlight scaling that maximizes backlight dimming while maintaining a pre-specified distortion level comprising:
a transmittance scaling module, wherein the transmittance scaling module receives image data of an image and derives histogram data on the image data; and
a dynamic backlight scaling controller coupled with the transmittance scaling module, wherein the dynamic backlight scaling controller determines a transmittance scaling value based on the histogram data, the pre-specified distortion level, and a human-visual-system-aware algorithm;
wherein the transmittance scaling module scales the image data based on the transmittance scaling value, and
wherein the transmittance scaling module comprises a hardware register level histogram analyzer, a plurality of grayscale counters, a multiplier, and a clock generator.

8. The system as recited in claim 7 wherein the pre-specified distortion level is user-defined.

9. The system as recited in claim 7 further comprising: a frame buffer coupled with the histogram generation module for buffering the image data.

10. The system as recited in claim 7 further comprising:
a Cold Cathode Fluorescent Lamp (CCFL) backlight inverter coupled with the transmittance scaling module and a display, the CCFL backlight inverter for controlling the CCFL intensity of the display, wherein the transmittance scaling module sets a backlight scaling value for the CCFL backlight inverter.

11. The system as recited in claim 7 wherein the transmittance scaling module scales RGB values of pixels of the image and puts the scaled RGB values on a pixel data line.

12. The system as recited in claim 11 wherein the pixel data line is configured to couple the transmittance scaling module with a display.

13. A non-transitory memory storing instructions that cause a computer system to execute a method for determining a pixel transformation function that maximizes backlight dimming while maintaining a pre-specified distortion level, the method comprising:
determining a minimum dynamic range of pixel values in a transformed image based on an original image ($x^{orig}$) and the pre-specified distortion level;
determining a scaling factor (κ) based on an adaptation luminance of the original image ($L_a^{orig}$) and an adaptation luminance of the transformed image ($L_a^{DTM}$);
determining a human contrast sensitivity change (γ) between the original image and the transformed image; and
deriving the pixel transformation function (ψ), wherein the pixel transformation function includes the scaling factor and the human contrast sensitivity change, and wherein the pixel transformation function produces the transformed image such that the perceived brightness of the transformed image is preserved while maintaining the minimum dynamic range, wherein $$\psi(\chi^{orig}) = \kappa(L_a^{orig}, L_a^{DTM}) \cdot \left(\frac{\chi^{orig}}{L_a^{orig}}\right)^{\gamma(L_a^{orig}, L_a^{DTM})}.$$

14. The memory of claim 13, wherein $$\kappa(L_a^{orig}, L_a^{DTM}) = \left(\frac{1.219 + (L_a^{DTM})^{0.4}}{1.219 + (L_a^{orig})^{0.4}}\right)^{2.5}.$$

15. The memory of claim 13, wherein $$\gamma(L_a^{orig}, L_a^{DTM}) = \frac{0.4 \cdot \log_{10}(L_a^{orig}) + 2.92}{0.4 \cdot \log_{10}(L_a^{DTM}) + 2.92}.$$

16. The memory of claim 13, wherein $L_a^{orig}$ and $L_a^{DTM}$ are approximated by ½ $L_{max}^{orig}$ and ½ $L_{max}^{DTM}$ respectively, wherein $L_{max}^{orig}$ and $L_{max}^{DTM}$ denote the maximum luminance of the original image and the transformed image respectively.

17. The memory of claim 13, wherein the pre-specified distortion level is user-defined.

18. The memory of claim 13, the method further comprising:
deriving histogram data based on the image data; and
determining a transmittance scaling value based on the transformed image.

* * * * *